United States Patent [19]

Kofel

[11] 3,966,345

[45] June 29, 1976

[54] TANDEM ROAD ROLLER

[75] Inventor: Ferdinand Kofel, Wallisellen, Switzerland

[73] Assignee: Koehring GmbH — Bomag Division, Boppard, Rhine, Germany

[22] Filed: Sept. 6, 1974

[21] Appl. No.: 503,851

[30] Foreign Application Priority Data

Sept. 8, 1973 Germany ..... 2345412

[52] U.S. Cl. ..... 404/126; 172/170; 280/468

[51] Int. Cl.[2] ..... E01C 19/26

[58] Field of Search ..... 404/126, 125, 122, ; 280/467, 468; 172/170, 174

[56] References Cited

UNITED STATES PATENTS

| | | | |
|---|---|---|---|
| 496,349 | 4/1893 | Credlebaugh | 404/126 |
| 1,369,977 | 3/1921 | McLaren | 404/126 |
| 1,637,208 | 7/1927 | Wilson | 404/126 |
| 1,650,746 | 11/1927 | Stubbs | 404/126 |
| 2,132,107 | 10/1938 | Hamm | 404/126 |
| 3,099,942 | 8/1963 | Leister | 404/122 |
| 3,368,292 | 2/1968 | Prinoth | 280/468 X |
| 3,394,641 | 7/1968 | Steck | 404/122 |
| 3,454,285 | 7/1969 | Van Peursem | 280/468 |

*Primary Examiner*—Nile C. Byers
*Attorney, Agent, or Firm*—Spencer & Kaye

[57] ABSTRACT

A tandem road roller having a pair of rolls arranged one behind the other which are capable of both pivoting relative to each other to negotiate curves and being offset relative to each other to vary the width of the roller track. The roller comprises a first frame member carried on the front roll, a second frame member carried on the rear roll, a connecting bar member hinged at opposite ends to the first and second frame members between the rolls, and an actuating mechanism operating on the first and second frame members to control their angular relationship and to control their lateral offset. Preferably the actuating mechanism includes two fluid pressure operated double-acting piston and cylinder assemblies and in this case one of the piston and cylinder assemblies is preferably arranged parallel to but spaced apart from the intermediate frame member and the other piston and cylinder assembly is connected diagonally between the one piston and cylinder assembly and the intermdiate frame member. With this arrangement one piston and cylinder assembly controls the steering of the roller whilst the other controls the rolling width of the roller.

6 Claims, 4 Drawing Figures

TANDEM ROAD ROLLER

This invention relates to tandem road rollers having a pair of rolls arranged one behind the other which are capable of both pivoting relative to each other to negotiate curves and being offset relative to each other to vary the width rolled.

In a known tandem road roller, the front and rear rolls are rotatably mounted in vertical yokes which are centrally journalled into the frame of the road roller. The angular relationship between each roll and the frame is controlled by a separate, independent steering device. The roller is steered and the rolled width is varied by these steering devices. Each steering device has included a worm and pinion assembly, the pinion being fixed to the yoke and the worm fixed to a long spindle which extends to the driver's position where it is mounted in a thrust bearing. At its end adjacent the driver's position the spindle is fitted with a hand wheel and rotation of the hand wheel turns the roll associated with the hand wheel to vary the angular relationship between the roll and the frame. On account of the high mechanical advantage of the steering device, which is particularly necessary in the case of heavy rolls to keep the steering forces to an acceptably low level, a large number of revolutions of the hand wheel are required to steer the rolls and consequently a change in direction can only be carried out slowly. Additionally, where the road rolls are fitted with a vibratory drive, the steering devices described above possess the additional disadvantage that the vibrations from the drive are transmitted directly to the hand wheels, which is, at the very least, uncomfortable for the operator or driver.

An object of this invention therefore is to provide a tandem road roller in which the device for steering and varying the width of the rolled track is compact, enabling long steering spindles to be dispensed with, and, in addition, for it to be possible for the operator of the roller to control the rolls without it being necessary to operate two mutually independent steering devices simultaneously.

According to this invention a tandem road roller comprises a pair of rolls mounted one behind the other, a first frame member carried on the front roll, a second frame member carried on the rear roll, an intermediate frame, or connecting bar, member hinged at opposite ends to the first and second frame members between the rolls, and an actuating mechanism operating on the first and second frame members to control their angular relationship to steer the roller and to control their lateral offset to vary the width of the rolling track of the roller.

Some equipment is already known which includes a single hinge joint, for example tractor shovels, but these each include only one hinge joint, so that it is not possible to offset the track between the front and rear wheels and the hinged frame is merely used for steering.

The actuating mechanism preferably comprises two fluid pressure operated, double acting piston and cylinder assemblies operating on the first and second frame members. The steering effort required by the operator is thereby limited to the actuation of a fluid pressure control unit, by means of which a supply of pressurised fluid to the piston and cylinder assemblies is regulated. It will be readily appreciated that the use of a fluid pressure piston and cylinder assembly and particularly a hydraulic piston and cylinder assembly not only makes high steering forces possible but also makes rapid steering changes possible.

It is further preferred that, when the roller is arranged for straight line movement, one piston and cylinder assembly is located a lateral distance away from and parallel to a line connecting axes of the hinges on the intermediate frame member and is hinged to and connected between the first and second frame members, and the other piston and cylinder assembly is hinged to and connected diagonally between the first and second frame members with the axis of one of its hinges aligned with the axis of the hinge between the first or second frame member and the intermediate frame member and with the axis of the other of its hinges aligned with the axis of the hinge between the one piston and cylinder assembly and the second or first frame member. By this arrangement of the piston and cylinder assemblies, a rectangular four-link mechanism is achieved, one of the members of which, namely the piston and cylinder assembly, is adjustable in length. As one of the diagonals of the four-link mechanism a further member of variable length is included. This enables the roller to be steered and the width of the rolled track to be changed independently by merely operating only one of the piston and cylinder assemblies for each of these motions. For steering, only the piston and cylinder assembly parallel to the connecting line between the axes of the hinge joints is actuated, whereas for offsetting the rolls only the diagonal piston and cylinder assembly is actuated.

The road roller may be a conventional compressive roller or it may include a vibratory drive and so be a double-vibratory roller. When hydraulic piston and cylinder assemblies are used in the actuating mechanism the roller is preferably equipped with a hydraulic drive, and the hydraulic fluid for operating the actuating mechanism is drawn from the hydraulic driving system.

An example of a road roller in accordance with this invention will now be described with reference to the accompanying drawings which are diagrammatic plan views and; in which.

Figure 1:
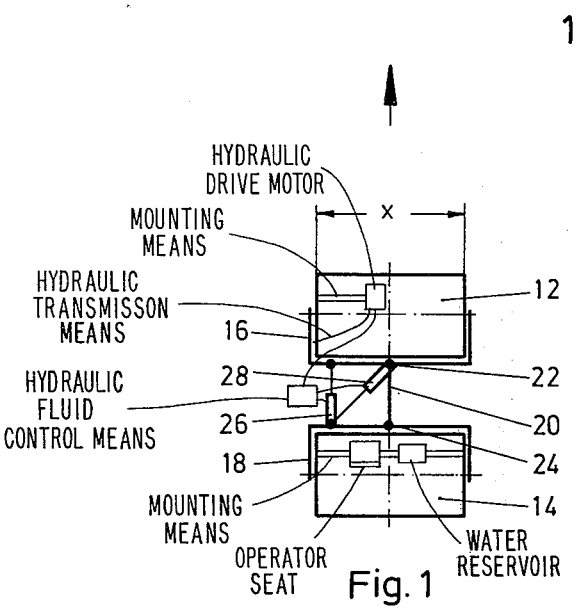
FIG. 1 shows the roller executing normal straight line travel.

A road roller 10 is similar to a conventional tandem roller and comprises a front roll 12 and a rear roll 14 journalled in a first yoke 16 and a second yoke 18 respectively. The yokes are shown only diagrammatically, are substantially horizontal and form parts of the frame of the machine. A drive motor (not shown) is mounted above the front roll 12, and drives a hydraulic pump which supplies a hydraulic motor unit attached to one or both of the rolls 12 and 14. A seat for the operator or driver and a water reservoir are mounted above the rear roll 14 to provide a satisfactory weight distribution. Between the forward roll 12 and the rear roll 14 a further, relatively short, intermediate frame member 20, indicated in the drawing only as a straight link, is provided. This intermediate frame member 20 is hinged to the yokes 16 and 18 by hinge joints 22 and 24 respectively.

Parallel to a line connecting the hinge joints 22 and 24 and laterally offset from the line, a double-acting huydraulic piston and cylinder unit 26 is mounted. The cylinder is hinged to the yoke 18 and the piston rod to the yoke 16. When this piston and cylinder assembly is in its mean position the rolls 12 and 14 will be parallel and the roller will move in a straight line. By extending or retracting the piston rod with respect to the cylinder, the rolls 12 and 14 are pivoted relative to each other to vary their angular relationship, and in this way steer the roller.

A second, double-acting hydraulic piston and cylinder assembly 28 is arranged diagonally in the four-link mechanism formed by the member 20, the yokes 16 and 18 and the piston and cylinder assembly 26. The cylinder of the assembly 28 is hinged to the middle of the yoke 16 and the axis of its hinge coincides with the axis of the joint 22. The piston rod of the assembly 28 is hinged to the yoke 18 and the axis of its hinge is coincident with the axis of the hinge between the cylinder of the assembly 26 and the yoke 18.

Hydraulic fluid is supplied to the piston and cylinder assemblies 26 and 28 under pressure to urge the pistons to move in the cylinders and enable the steering movements and lateral displacement of the rolls to be carried out. The hydraulic fluid is drawn from the hydraulic pump providing the drive for the roller.

Figure 2:
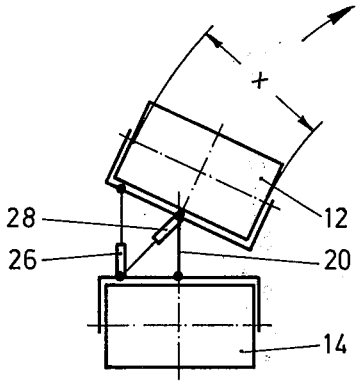
FIG. 2 shows the roller negotiating a curve with both the front and rear rolls following the same track.

To steer the road roller 10 from its straight line travel position shown in FIG. 1 towards the right, the piston and cylinder assembly 26 is extended, so that the roll 12 is pivoted in the required direction, as shown in FIG. 2. To steer the roller in the opposite direction the piston is retracted into the piston and cylinder assembly 26.

Figure 3:
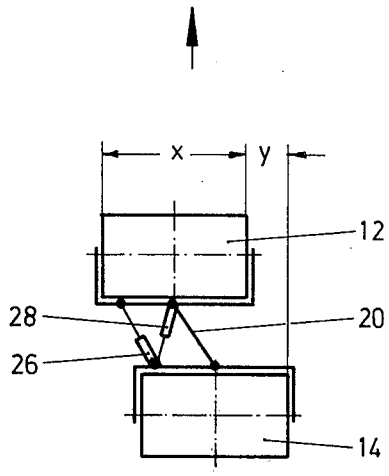
FIG. 3 shows the roller with the rolls laterally offset but the roller executing straight line travel; and, FIG. 4 shows the road roller with the rolls laterally offset but negotiating a curve.

To change the width of the rolled track with straight line travel, the piston and cylinder assembly 28 is either retracted as shown in FIG. 3, so that the roll 12 is offset to the left relative to the roll 14, or the piston and cylinder assembly 28 is extended, so that the two rolls are then offset in the opposite way. Provided that the piston and cylinder assembly 26 is not operated during these changes, it will act solely as a link of constant length and the four-link mechanism will take the form of a parallelogram, so that the axes of the rolls 12 and 14 remain parallel to each other.

Figure 4:
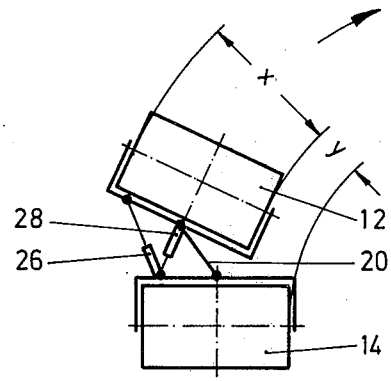

Only the piston and cylinder unit 26 needs to be actuated, if a change in direction is required with the rolls 12 and 14 in the offset position of so-called "dog travel". FIG. 4 shows that steering towards the right is again obtained by extending the piston and cylinder unit 26, only this time with the road roller in the dog travel position. The additional rolled width $y$ obtained over and above the normal rolled width $x$ is maintained during negotiation of a curve, provided that the piston and cylinder unit 28 is not also operated.

From the foregoing explanations it will be seen that a road roller constructed in accordance with this invention possesses appreciable advantages in particular with regard to compactness and ease of operation compared with known tandem road rollers.

I claim:

1. In a tandem road roller including a front roll, a rear roll, a roller frame composed of first and second frame members connected together in a jointed manner to form a center pivot steering assembly, with said front roll being rotatably mounted in said first frame member and said rear roll being rotatably mounted in said second frame member, a first piston-cylinder assembly having one end pivotally connected to said first frame member and its other end pivotally connected to said second frame member to form a first link between said frame members for controlling the angular relationship between said frame members to steer said roller, the improvement comprising: a connecting bar member having its opposite ends pivotally connected to respective ones of said frame members to form a second link between said frame members, the pivotal connections of said first and second links to each said frame member being laterally spaced from one another on each said frame member, and a second pistoncylinder assembly pivotally connected between substantially diametrically opposed points of the linkage formed by said first and second links and the portions of said frame members between the pivotal connections of said links and actuable for laterally offsetting said frame members relative to one another in a manner to vary the total width of the rolling track of said roller.

2. A road roller in accordance with claim 1 wherein one end of said second piston-cylinder assembly is connected to be pivotal about an axis coaxial with the pivot axis of that end of said connecting bar member which is connected to said first frame member, and the other end of said second piston-cylinder assembly is connected to be pivotal about an axis coaxial with the pivot axis of that end of said first piston-cylinder assembly which is connected to said second frame member.

3. A road roller in accordance with claim 1, further comprising a drive motor for said roller, means mounting said drive motor above said front roll, transmission means transmitting power from said drive motor to said front roll, a seat for an operator, a water reservoir, and means mounting said seat and said water reservoir above said rear roll.

4. A road roller in accordance with claim 1, including a vibratory drive mechanism and transmission means for transmitting said vibratory drive to at least one of said rolls.

5. A road roller in accordance with claim 1, wherein said roller includes a drive motor and hydraulic means for transmitting power from said drive motor to at least one of said rolls.

6. A tandem road roller comprising a front roll, a rear roll, a first frame member, means rotatably mounting said first frame member on said front roll, a second frame member, means rotatably mounting said second frame member on said rear roll, a connecting bar member having a front end and a rear end, a first hinge joint assembly on said front end hingedly connecting said connecting bar member to said first frame member, a second hinge joint assembly on said rear end hingedly connecting said connecting bar member to said second frame member, said first and said second hinge joint assemblies being located between said front and said rear rolls, a hydraulic drive motor, means mounting said hydraulic drive motor above said front roll, hydraulic transmission means connected between said hydraulic drive motor and said front roll for transmitting power from said hydraulic drive motor to said front roll, a first hydraulic double-acting piston and cylinder assembly, means pivotally mounting said first hydraulic piston and cylinder assembly between said first frame member and said second frame member, said first hydraulic double-acting piston and cylinder assembly being arranged parallel to but laterally spaced apart from a line joining said first and said second hinge joint assemblies when said roller is arranged for travel along a straight path, a second hydraulic double-acting piston and cylinder assembly, means pivotally mounting said second hydraulic piston and cylinder assembly diagonally between, and coaxially with, said first hinge joint assembly and said means pivotally mounting said first hydraulic piston and cylinder assembly on said second frame member, and hydraulic fluid control means communicating said first and said second hydraulic piston and cylinder assemblies with hydraulic fluid from said hydraulic drive motor to operate said piston and cylinder assemblies.

* * * * *